US005957644A

United States Patent [19]

Vaughan

[11] Patent Number: 5,957,644

[45] Date of Patent: Sep. 28, 1999

[54] HANGER FOR USE IN CONCRETE STRUCTURES

[76] Inventor: James A. Vaughan, 931 Fehrs Way, Pahrump, Nev. 89048

[21] Appl. No.: 09/038,401

[22] Filed: Mar. 11, 1998

Related U.S. Application Data

[60] Provisional application No. 60/040,180, Mar. 11, 1997.

[51] Int. Cl.[6] ..... E04B 1/38; F16B 39/02

[52] U.S. Cl. ..... 411/82; 52/707

[58] Field of Search ..... 411/82, 82.1, 258, 411/547, 546; 52/699, 715, 707

[56] References Cited

U.S. PATENT DOCUMENTS

| | | | |
|---|---|---|---|
| D. 342,011 | 12/1993 | Maguire . | |
| 450,753 | 4/1891 | Cary | 411/463 |
| 1,114,013 | 10/1914 | Millar | 411/82 |
| 1,768,246 | 6/1930 | Gaddis | 52/699 |
| 1,810,808 | 6/1931 | Yost | 411/462 |
| 1,948,093 | 2/1934 | Baird | 52/707 |
| 2,382,474 | 8/1945 | Gambo | 411/462 |
| 2,873,496 | 2/1959 | Elms | 411/523 |
| 3,894,368 | 7/1975 | Crofoot | 52/699 |
| 4,693,657 | 9/1987 | VanManen | 411/547 |
| 5,205,690 | 4/1993 | Roth . | |
| 5,322,400 | 6/1994 | Ford | 411/258 |
| 5,564,248 | 10/1996 | Callies | 52/715 |

*Primary Examiner*—Flemming Saether
*Attorney, Agent, or Firm*—Wallenstein & Wagner, Ltd

[57] ABSTRACT

The present invention is an insert to be embedded in concrete for securing an object to a concrete surface. The insert comprises a u-shaped body having a bridge connecting two legs, each leg terminating in a flange. The body provides a flow passage in each leg for allowing the concrete to flow through the legs. Also, the legs are substantially planer and each leg has a rib portion that extends from the plane to provide added strength. The body further comprises a seam joining the bridge to each leg, and the seam is provided with a reinforcing notch. Similarly, a seam joins each leg to each flange, and the seam also has a reinforcing notch.

9 Claims, 2 Drawing Sheets

HANGER FOR USE IN CONCRETE STRUCTURES

RELATED APPLICATIONS

This Application claims the benefit of U.S. Provisional Application Ser. No. 60/040,180, filed Mar. 11, 1997.

TECHNICAL FIELD

The present invention relates to concrete embedded inserts for attachment of other devices.

BACKGROUND OF THE INVENTION

Concrete embedded insert are used for securing objects to concrete surfaces. Typical applications include securing pipes or conduit to concrete walls, ceilings or floors. In such an application, an insert is positioned in the concrete so that when the concrete sets, either a bolt extends from the concrete surface or, alternatively, an internally-threaded rod coupler is set within the concrete to receive a bolt. Typically, a metal insert is secured to a wooden or metal form before the concrete is poured on the form. After the concrete hardens and the form is removed, the rod coupler is set in the plan of the concrete allowing a fastener to be secured to the coupler. Alternatively, if a metal form is retained after the concrete hardens, the metal form is adapted with a hole to receive the coupler or bolt, allowing the coupler or bolt to extend beyond the form and secure an object.

U.S. Pat. No. 5,205,690, issued to Roth on Apr. 27, 1993, discloses a concrete insert for attaching utility hangers to a structure. Roth discloses a U-shaped member having two legs, each terminating in a lateral flange, and a bridge connecting the two legs. The bridge has a hole through which an internally threaded coupling extends. The coupling has an outer surface, which is dimensioned to be in frictional contact with the hole when the coupling is placed in the hole. When concrete is poured around the insert and it hardens, the insert is firmly embedded in the concrete. The body of Roth, however, features no strengthening features or flow passages.

U.S. Pat. No. Des. 342,011, issued to Maguire on Dec. 7, 1993, discloses the ornamental features of a Foundation Bolt Mounting Bracket. The body of Maguire is also missing certain strengthening features.

SUMMARY OF THE INVENTION

This invention is an improved seismic insert to be embedded in concrete for securing an object to a concrete surface. The insert would typically be used for seismic restraining or for pipe hanging. The insert generally comprises a u-shaped body having a bridge that connects two legs, each leg terminating in a flange. The bridge has an opening. A coupling connects to the u-shaped body and is adapted to secure an object to the concrete surface after the insert is embedded. The coupling has a first end and a second end, the first end for receiving a fastener and the second end for securing the object. The fastener is adapted to extend through the opening of the bridge and secure a member and the U-shaped body to the coupling.

One aspect of the invention is to provide a flow passage in a leg of the body for allowing the concrete to flow through and surround the leg. Another object of the invention is to provide additional strength to the insert. Accordingly, the legs are substantially planer and each leg has a rib portion that extends from the plane. Another aspect of the invention provides that each leg has a plurality of rib portions. In another aspect of the invention, the body comprises a seam joining the bridge to each leg and the seam is adapted to provide a reinforcing notch. In another aspect of the invention, the body comprises a seam joining each leg to each flange, and the seam is adapted to provide a reinforcing notch.

Other advantages and aspects of the present invention will become apparent upon reading the following description of the drawings and detailed description of the invention.

DETAILED DESCRIPTION

Figure 1:
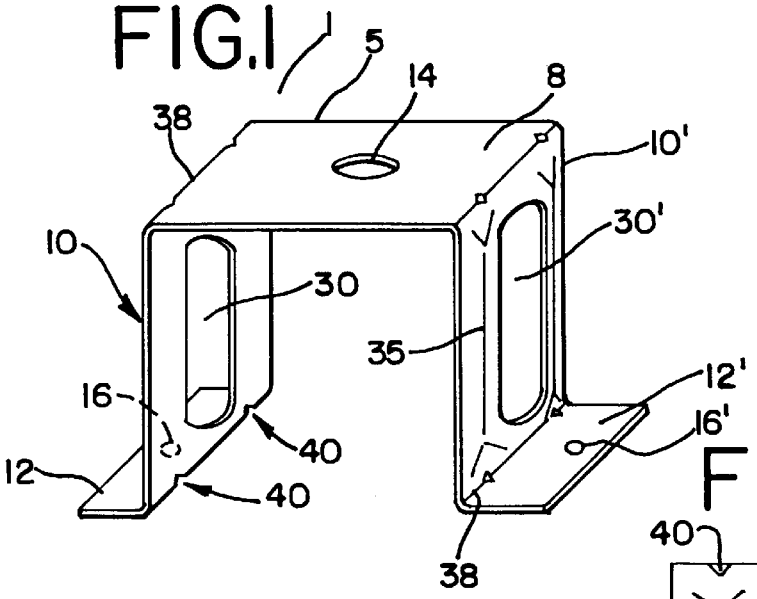
FIG. 1 is a prospective view of a concrete-embedded insert body of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

FIG. 1 illustrates an insert 1 of the present invention. A u-shaped body 5 has a bridge 8 connecting two legs 10,10'. Each leg 10,10' terminates in a flange 12,12', also called a mounting base. The bridge 8 has an opening 14 adapted to receive a fastener 15, such as bolts of various sizes. Each flange 12,12' is provided with a mounting hole 16,16'. The body 5 is formed from a rigid material such as metal or plastic, preferably, a non-rusting material, such as, zinc plating, stainless steel, or plastic.

Figure 2:
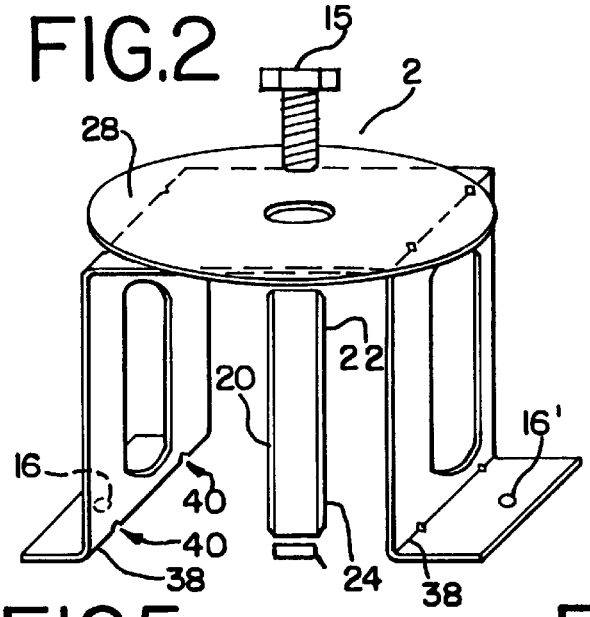
FIG. 2 is a prospective view a first embodiment of insert body illustrated in FIG. 1.

As seen in FIG. 2, a first embodiment of the invention includes an insert assembly 2 comprising a coupler 20, a member or plate 28, a fastener 15, and a coupler protection device 25. The coupler 20 has a first end 22 and a second end 24. In the first embodiment, the coupler 20 is a rod coupler nut having a hexagonal cross section and internal threads. The first end 22 of the coupler 20 receives a fastener 15 in a receptacle 17. The second end 24 of the coupler 20 secures an object to the concrete surface after the insert assembly 2 is embedded in the concrete. The fastener 15 is adapted to extend through the opening 14 of the bridge 8 and secure both a member 28 and the u-shaped body 5 to the coupling 20. In the preferred embodiment, the member 28 is a washer, which provides a relatively larger diameter surface area for supporting a load, and is made from a heavy metal material.

Figure 5:
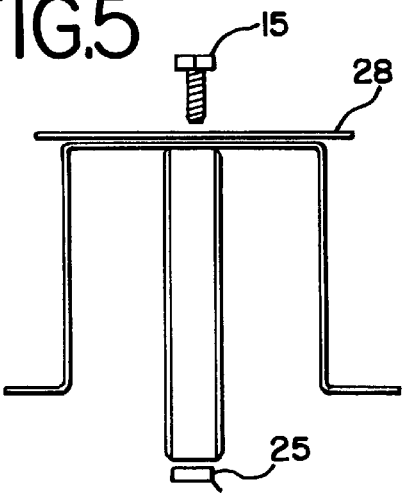
FIG. 5 is a partially exploded plan view of the insert illustrated in FIG. 2 having a coupler of different length than FIG. 2.
Figure 6:
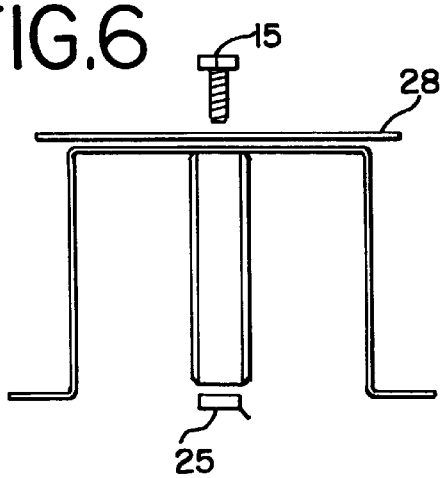
FIG. 6 is a partially exploded plan view of the insert illustrated in FIG. 2.
Figure 9:
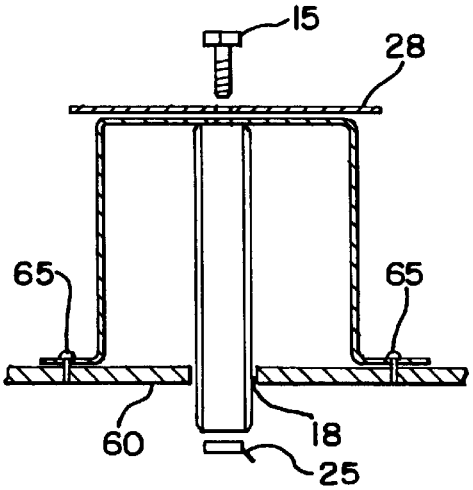
FIG. 9 is a plan view of the first embodiment of the assembled insert illustrated in FIG. 1 in position fastened to a media.
Figure 10:
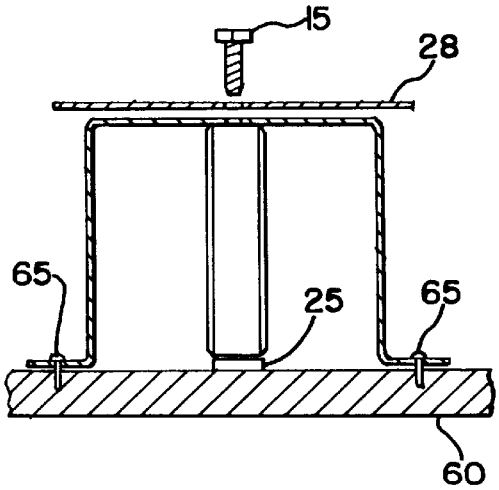
FIG. 10 is a plan view of the first embodiment of the assembled insert illustrated in FIG. 1 in position fastened to a media.

During installation, the second end 24 of the coupler 20 is fitted with a coupler protection device 25, which prevents concrete or other debris from degrading the internal threads of the coupler 20. In the first embodiment, the coupler protection device 25 is made from a plastic material that is forcibly inserted, and engaged, by the internal threads of the coupler 20. As illustrated in FIGS. 5 and 6, the coupler 20 may be made of varying lengths to accommodate different applications. As illustrated in FIG. 10, when a media 60 is removed after the concrete hardens, the coupler 20 should be an appropriate length so the receptacle 17 is in the plane of the concrete surface so the receptacle 17 is able to receive a fastener (not shown) to secure an object. As illustrated in FIG. 9, if the media 60 is to be retained after the concrete hardens, such as when metal decking is used, the coupler 20 must extend through a hole 18 in the media 60.

Figure 3:
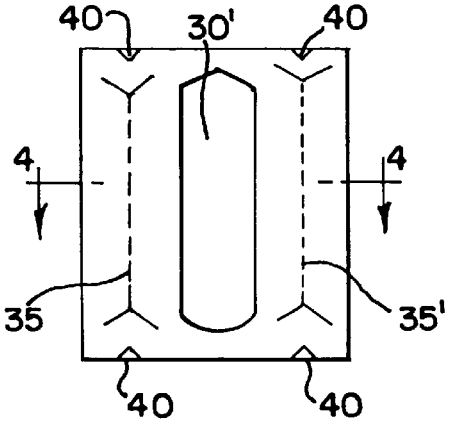
FIG. 3 is a plan view of one leg of the insert body of the present invention.

As illustrated in FIGS. 1 and 3, each leg 10,10' provides a flow passage 30,30' for allowing the concrete to flow through and surround the leg 10,10'. The flow passages 30,30' allow the concrete to completely surround the legs 10,10' for added strength and to prevent the insert 1 from slipping in the concrete.

Figure 4:
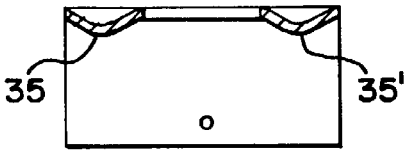
FIG. 4 is a cross-sectional plan view along line A—A of one leg of the insert body illustrated in FIG. 1.

As shown in FIGS. 5 and 6, each leg is substantially planer. However, as shown in FIGS. 3 and 4, each leg has a rib portion 35, also called concave or convex strengthening rib, that extends from the plane defined by the respective leg. In the preferred embodiment, each leg 10,10' has two rib portions 35,35', one positioned on either side of the flow passage 30,30'.

The body 5 is further provided with a seam 38 joining the bridge 8 to each leg 10,10' and another seam 38 joining each leg 10,10' to each flange 12,12'. The seams 38 are provided with a reinforcing notch 40, also called strengthening indentations. Each reinforcing notch 40 is formed by stamping a crease into, and generally perpendicular to, the seam 38. The reinforcing notch 40 provides additional strength to the body 5. In the preferred embodiment, the body 5 is provided with eight reinforcing notches 40. As shown in FIGS. 1–3, a reinforcing notch 40 corresponds, and lines up, with either end of the strengthening ribs 35. Thus, there are two reinforcing notches 40 on the seam 38 joining each leg 10,10' and the bridge 8, and two reinforcing notches 40 on the seam 38 joining each leg 10,10' and each flange 12,12'.

Figure 7:
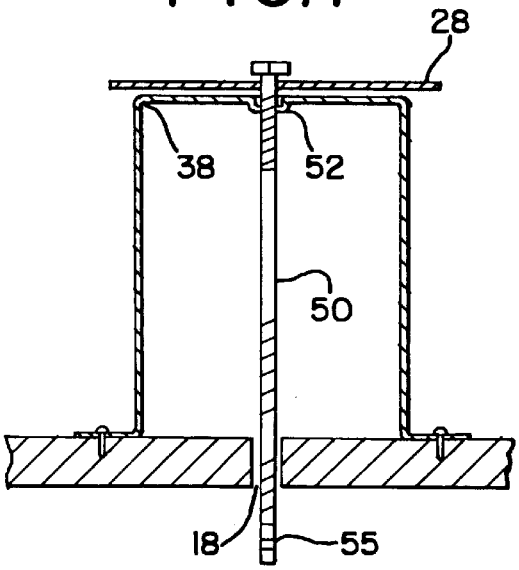
FIG. 7 is a plan view of a second embodiment of an assembled insert illustrated in FIG. 1 in position fastened to a media.

As illustrated in FIGS. 2, 5, and 6, the insert assembly 2 is assembled by extending the fastener 15 through the member 28 and through the opening 14 in the body 5, and inserting the fastener 15 to the internal threads of the first end 22 of the coupling 20. As illustrated in FIGS. 7, 9, and 10, the flanges 12,12' of the insert assembly 2 are placed onto a wood or metal media 60 that supports the poured concrete. Before concrete is poured, the flanges 12,12' are mounted to the media 60 using a fastener 65, such as, a nail, screw, or rivet. Wet concrete is poured over the supporting media 60, completely covering the insert assembly 2. When the concrete is cured for the proper length of time, the media may optionally be removed, exposing the bottom of the flanges 12,12', the second end of the coupler 24, and the coupler protection device 25. The coupler protection device 25 can then be removed, exposing the internal threads of the coupler 20. A fastener (not shown), such as a bolt or all-thread rod, may then be engaged by the coupler for securing an object to the concrete surface.

Figure 8:
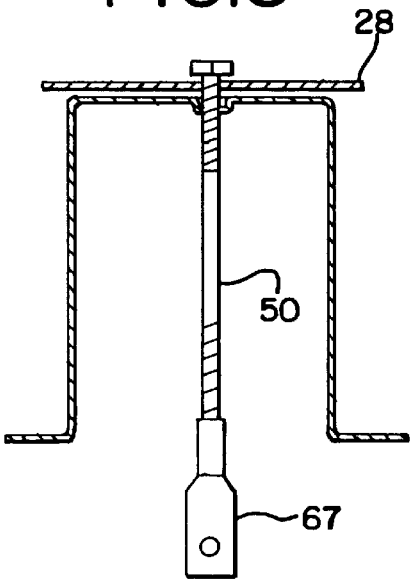
FIG. 8 is a plan view of the second embodiment of the assembled insert illustrated in FIG. 1.

FIGS. 7 and 8 illustrate a second embodiment of the present invention. The u-shaped body 5 of the insert is substantially the same as in the first embodiment. However, rather than employing a coupler 20, the second embodiment instead uses a long fastener 50. The long fastener 50 secures the member 28 and the body 5 by cooperating with a receptacle 52. In the preferred embodiment, the long fastener 50 is a full-threaded bolt, and the receptacle 52 is a jamb nut, which cooperatively engages the full threaded bolt. As illustrated in FIG. 7, the long fastener 50 extends through the media 60 before the concrete is poured. An external fastener protector 55 surrounds the long fastener 50 to protect the long fastener 50 from the poured concrete. After the insert assembly 2 is set in concrete, the external fastener protector 55 can be removed and a connector 67, such as, for example, a spade nut or eye bolt, can be secured to the long fastener 50 for securing an object to the concrete surface.

While the specific embodiments have been illustrated and described, numerous modifications come to mind without significantly departing from the spirit of the invention and the scope of protection is only limited by the scope of the accompanying claims.

I claim:

1. An insert to be embedded in concrete for securing an object to a concrete surface, comprising:

a u-shaped body having a bridge with a top surface having a peripheral edge and a bottom surface, the bridge connecting a plurality of legs, each leg terminating in a flange;

a plate compressed with the top surface of the bridge and extending beyond the peripheral edge has a greater surface area than a surface area of the top surface of the bridge;

a coupler having a first end abutting the bottom surface of the bridge and a second end extending downwardly toward the flanges; and a flow passage in a leg for allowing the concrete to flow through the leg.

2. The insert of claim 1, wherein each leg comprises a flow passage.

3. The insert of claim 1, wherein the legs are substantially planar and each leg has a rib portion that extends from the plane.

4. The insert of claim 3, wherein each leg has a plurality of rib portions.

5. The insert of claim 1, wherein the body further comprises a seam joining the bridge to each leg, the seam having a reinforcing notch.

6. The insert of claim 1, wherein the body further comprises a seam joining each leg to each flange, the seam having a reinforcing notch.

7. The insert of claim 1, wherein the bridge includes an opening and the first end of the coupler is adapted for receiving a fastener which extends through an opening in the bridge and secures the plate and the u-shaped body to the coupling.

8. The insert of claim 1, wherein the first end of the coupler is fixedly attached to the bottom surface of the bridge.

9. An insert to be embedded in concrete for securing an object to a concrete surface, comprising:

a u-shaped body having a bridge with a top surface having a peripheral edge and a bottom surface, the bridge including an opening, the bridge having a plurality of first seams each having a first reinforcing notch for connecting the bridge to a plurality of substantially planar legs, each substantially planar leg having a second seam having a second reinforcing notch for joining the substantially planar legs to a flange, and each substantially planar leg further having a plurality of rib portions that extend from the plane;

a plate compressed with the top surface of the bridge and extending beyond the peripheral edge;

a coupler having a first end fixedly attached to a portion of the bridge and a second end extending downwardly toward the flanges, the first end of the coupler adapted for receiving a fastener which extends through the opening in the bridge and secures the plate and the u-shaped body to the coupling; and a flow passage in each substantially planar leg for allowing the concrete to flow through the substantially planar legs.

* * * * *